US005442260A

United States Patent [19]

Saito et al.

[11] Patent Number: 5,442,260

[45] Date of Patent: Aug. 15, 1995

[54] LIGHT-EMITTING ELEMENT DRIVE CIRCUIT

[75] Inventors: Hiroyuki Saito; Akira Ito, both of Chiba, Japan

[73] Assignee: Seikosha Co., Ltd., Japan

[21] Appl. No.: 221,057

[22] Filed: Mar. 30, 1994

[30] Foreign Application Priority Data

Mar. 30, 1993 [JP] Japan ..... 5-015400 U

[51] Int. Cl.[6] ..... H05B 37/00

[52] U.S. Cl. ..... 315/241 P; 315/200 A; 315/240; 354/415; 354/418; 354/145.1

[58] Field of Search ..... 315/200 R, 200 A, 209 R, 315/291, 227 R, 240, 362, 129, 187, 188, 193; 354/145.1, 413–424

[56] References Cited

U.S. PATENT DOCUMENTS

| | | | |
|---|---|---|---|
| 4,803,507 | 2/1989 | Akashi et al. | 354/400 |
| 4,942,340 | 7/1990 | Ikawa | 315/241 P |
| 5,032,864 | 7/1991 | Ishimura et al. | 354/484 |
| 5,327,070 | 7/1994 | Seki et al. | 323/222 |

*Primary Examiner*—Robert J. Pascal
*Assistant Examiner*—Haissa Philogene
*Attorney, Agent, or Firm*—Adams & Wilks

[57] ABSTRACT

A light-emitting element drive circuit for a camera comprises a diode and a light-emitting element connected in series with each other between a power source and ground, a first switching element switchable between on and off states for driving the light-emitting element, second and third switching elements connected in series with each other between the power source and ground, and a capacitor connected between a junction point of the diode and light-emitting element and a junction point of the second and third switching elements. The second and third switching elements also constitute switching elements of a drive circuit for driving a DC motor, whereby the light-emitting element can be driven with a voltage which is approximately twice as high as the power source voltage. Since the light-emitting element is driven by a capacitor charge/-discharge operation instead of using a boosted power source, the consumption of current is reduced and the light-emitting period is shortened.

16 Claims, 4 Drawing Sheets

LIGHT-EMITTING ELEMENT DRIVE CIRCUIT

BACKGROUND OF THE INVENTION

This present invention relates to a light-emitting element drive circuit and, more particularly, relates to a circuit for driving a light-emitting element for use with a camera.

Recently, there has been an increasing trend toward miniaturization of cameras, and it is now commonplace to use a single 3-volt lithium battery as the power source for driving the entire system of a camera. If necessary, the battery output voltage may be boosted by a booster circuit. For example, when a light-emitting diode is used as a light-emitting element in the known active-type automatic focusing circuit, it requires a suitable forward voltage, and a camera using a 3-volt battery is, in many cases, driven by a boosted power source.

One example of a conventional light-emitting diode drive circuit for a camera is shown in FIG. 3. As shown, a battery 30 supplies power to each of the circuits constituting the system of a camera. A coil 31, a transistor 32, a diode 33 and a capacitor 34 are connected as shown and constitute a known chopper-type booster circuit. The transistor 32 repeats an on/off operation at a high frequency (on the order of about several tens to several hundreds kHz) according to a signal from a booster control circuit 32*a*. When the transistor 32 is on, the potential of point Pa is substantially equal to ground potential so that the coil 31 generates a counter-electromotive force at both ends thereof and stores electric energy therein. On the other hand, when the transistor 32 is off, the electric energy stored in the coil 31 is outputted to the post-stage circuits through the diode 33, and a part of the energy is stored in the capacitor 34. The input and output energy levels of the capacitor 34 can be balanced by suitably modifying the duty ratio of the pulse signal for driving the transistor 32 so that the voltage at point Pb becomes a predetermined value. As a result, a constant voltage to be supplied to the circuit 35 which constitutes the system of the camera appears at point Pb.

A resistor 36 is a low level resistor connected to point Pb for supplying electrical charge to a capacitor 37. The capacitor 37 stores the electric charge supplied thereto through the resistor 36. A transistor 39 is connected in series with a near-infrared light-emitting element 38 to control current flow through the element 38 under control of a light-emitting signal generating circuit 39*a*. If a sufficient electrical charge is stored in the capacitor 37 and the transistor 39 is off, then the electric potential at a point Pc is substantially equal to that of point Pb. When a light-emitting signal is outputted from the light-emitting signal generating circuit 39*a*, the transistor 39 is turned on and drives the near-infrared light-emitting element 38, and the electrical charge stored in the capacitor 37 flows straight to the element 38 to cause the latter to emit light. When the transistor 39 is turned off to terminate the emission of light, the potential at point Pc is lower than the potential at point Pb and, therefore, the capacitor 37 is again supplied with electric charge through the resistor 36.

Further, there is described in Japanese Laid-Open Utility Model Publication No. 61-142463 a booster circuit which uses two switching elements Q1 and Q2 as shown in FIG. 4. This circuit includes a diode D1 as a light-emitting element. A capacitor C1 is charged through a charging circuit comprised of a power source Vcc, a resistor R5, a resistor R2, a capacitor C1, a resistor R4 and ground. The diode D1 is driven through a driving circuit comprised of the power source Vcc, the resistor R5, the transistor Q2, the diode D1, the capacitor C1, the transistor Q1 and ground.

The drive circuit shown in FIG. 3 has several disadvantages. Firstly, since the circuits constituting the camera system and the light-emitting element drive circuit are connected to the same system power source, the system power source voltage fluctuates due to the emission of near-infrared light by the light-emitting element 38 and the fluctuations become noise. In this case, if the light-emitting cycle of the near-infrared light-emitting element 38 is attempted to be shortened, the consumption of power per unit hour increases thereby increasing the possibility that the camera system will malfunction due to a lowering of the power source voltage. Moreover, since the capacitor 37 is generally required to be an electrolytic capacitor of large capacity, such is disadvantageous from the standpoint of miniaturization and space reduction of the camera.

Further, as the circuitry shown in FIG. 4 requires the provision of an independent drive circuit for driving the light-emitting element, it is also disadvantageous from the standpoint of miniaturization and space reduction.

SUMMARY OF THE INVENTION

In order to solve the above-mentioned drawbacks, the drive circuit according to the present invention is provided with a diode and a light-emitting element connected in series between a power source and ground, a first switching element for driving the light-emitting element, second and third switching elements connected in series between the power source and ground, and a capacitor connected between the junction point of the diode and the light-emitting element and the junction point of the second and third switching elements.

With such an arrangement, the second and third switching elements of the light-emitting element drive circuit share part of a known bridge circuit for driving a DC motor, and the power source for the light-emitting element drive circuit is separated from that of the other circuits. Further, the entire circuit system can be miniaturized and, at the same time, the reliability of the system can be improved.

DETAILED DESCRIPTION OF THE INVENTION

Figure 1:
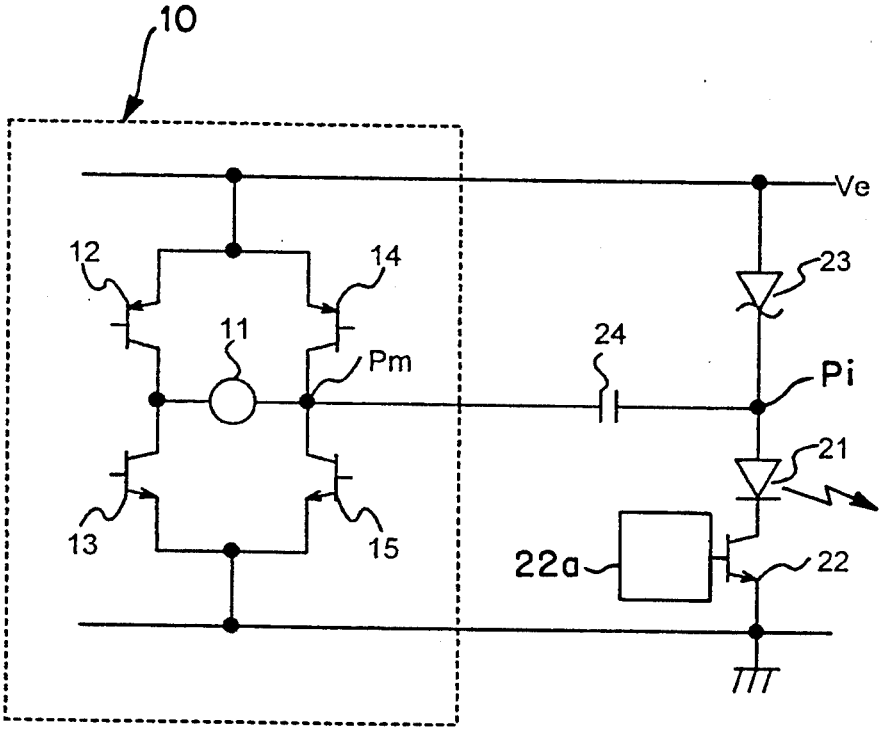
FIG. 1 is a circuit diagram of a preferred embodiment of drive circuit according to the present invention.

One embodiment of a drive circuit for driving a light-emitting element of a camera will be described with reference to FIG. 1. In FIG. 1, a motor drive circuit 10 is a known bridge circuit for driving a motor 11 and comprises a pair of NPN transistors 12 and 14 and a pair of PNP transistors 13 and 15. The operation of the motor 11 is controlled by these two pairs of transistors such that the motor turns or runs in one direction when the transistors 12 and 15 are on, and turns or runs in the opposite direction when the transistors 14 and 13 are on. In order to stop the running motor, the transistors 13 and 15 are turned on.

A near-infrared light-emitting element 21 is used to project a beam of light toward an object to be photographed for the purpose of distance measurement. A transistor 22 is turned on and off by a light-emitting signal generating circuit 22*a* for driving the near-infrared light-emitting element 21. A diode 23 is connected between the near-infrared light-emitting element 21 and the power source Ve to prevent any backflow of electric current. A capacitor 24 is connected between a junction point Pi of the near-infrared light-emitting element 21 and the diode 23 and a junction point Pm of the transistors 14 and 15.

Figure 2:
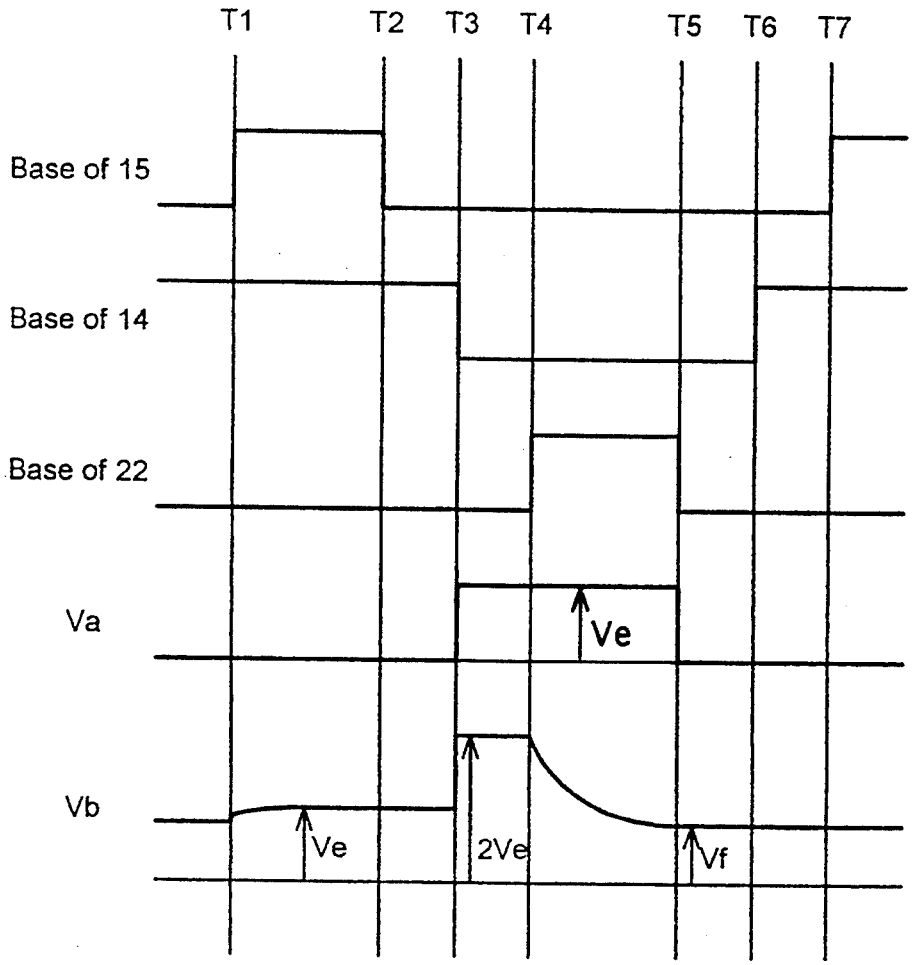
FIG. 2 is a timing chart illustrating the operation of the drive circuit of FIG. 1.
Figure 3:
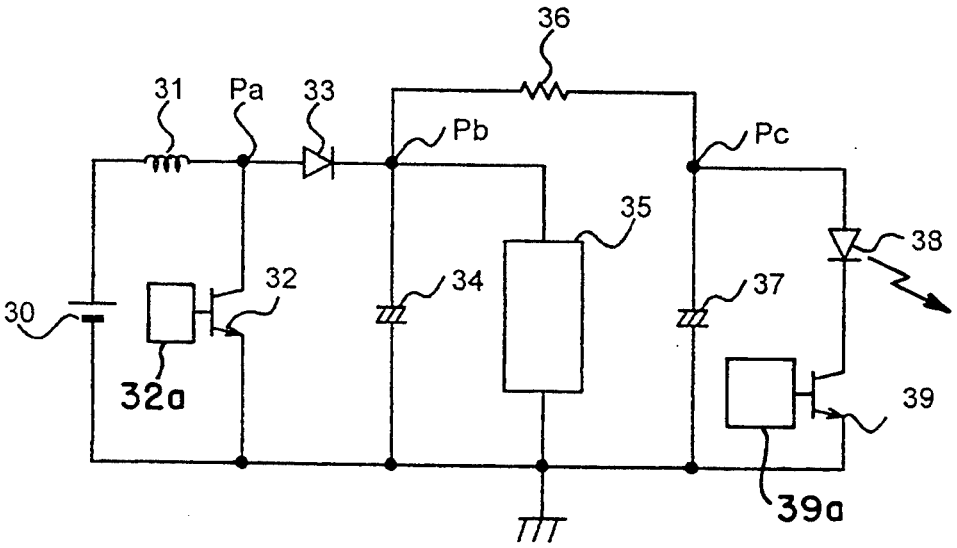
Fig. 3 (PRIOR ART)
FIG. 3 is a circuit diagram of one example of a conventional light-emitting element drive circuit.
Figure 4:
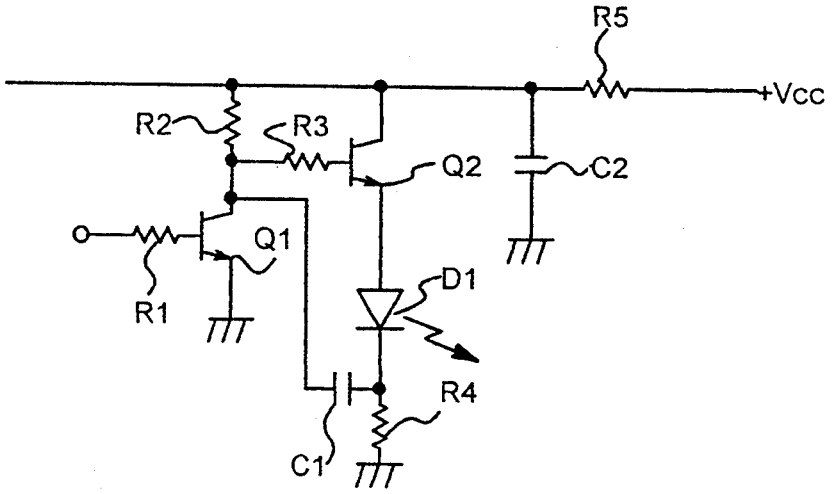
Fig. 4 (PRIOR ART)
FIG. 4 is a circuit diagram of another example of a conventional light-emitting element drive circuit.

The operation of the above circuit will be described with reference to FIG. 2, which shows the timing of the waveforms applied to the bases of the transistors 14, 15 and 22 and of the voltages Va and Vb appearing, respectively, at the junction points Pm and Pi. Before time T1, the capacitor 24 is discharged and free of electric charge and all the transistors 12, 13, 14, 15 and 22 are off. When the transistor 15 turns on at the time T1, an electric current flows through a circuit path defined by the voltage source Ve, diode 23, junction point Pi, capacitor 24, junction point Pm, transistor 15 and ground until the potential of point Pi becomes substantially equal to the power source voltage Ve. When the transistor 15 is turned off at time T2, the capacitor 24 becomes electrically isolated and no electric current flows therethrough. Subsequently, when the transistor 14 is turned on at time T3, the potential of point Pm becomes substantially equal to the power source voltage Ve while the potential of point Pi comes to a level of about 2Ve because the voltage of the capacitor 24 is superimposed thereon. In this case, no electric current flows toward the power source line because of the provision of the diode 23 and, therefore, none of the other circuits of the camera drive system are affected by the potential changes.

Thereafter, when the transistor 22 is turned on, at time T4, the electric charge stored in the capacitor 24 is discharged to ground through the near-infrared light-emitting element 21 and the collector-emitter path of the transistor 22 so that the element 21 emits light. Since a voltage of 2Ve is applied to the near-infrared light-emitting element 21 at the time when the electric discharge current begins to flow, the element 21 can be made to glow very effectively. The capacitor 24 continues discharging its electric charge until time T5 when the transistor 22 is turned off and the potential of point Pi is substantially equal to the forward voltage Vf of the near-infrared light-emitting element 21. Then, when the transistor 14 is turned off at time T6, the capacitor 24 loses all of its electric charge and returns to the same discharged state in which it was before time T1. When the transistor 15 is turned on at time T7, the capacitor 24 begins to be charged again to raise the potential of point Pi, and thereafter, the above-described cycle of operation is repeated.

Although, in the above-described embodiment, the near-infrared light-emitting element is driven by simply short-circuiting the light-emitting element between the point Pi and ground, it may also be driven with a constant current by applying a current feedback to the transistor 22 in order to make the electric current flowing through the near-infrared light-emitting element independent of the voltage Ve and to stabilize the amount of light emission of the light-emitting element.

According to the circuitry of the present invention, the bridge motor drive circuit is used as a part of the light-emitting element drive circuit, and the light-emitting element can be driven by a voltage which is approximately twice as high as the power source voltage simply by adding a small circuit component to the system. Further, since the light-emitting element can be driven by a capacitor charge/discharage operation instead of using a boosted power source voltage, the consumption of current can be reduced and the light-emitting period can be shortened as compared to the conventional method of using a boosted power source.

We claim:

1. A light-emitting element drive circuit comprising: a diode and a light-emitting element connected in series with each other between a power source and ground; a first switching element switchable between on and off states for driving the light-emitting element; second and third switching elements connected in series with each other between the power source and ground; and a capacitor connected between a junction point of the diode and light-emitting element and a junction point of the second and third switching elements.

2. A light-emitting element drive circuit according to claim 1; wherein the second and third switching elements comprise switching elements of a drive circuit for driving a DC motor.

3. A drive circuit for driving a light-emitting element, comprising: light-emitting means operable when driven for emitting light; first switching means switchable to first and second switching states for controlling the flow of electric charge through the light-emitting means; and circuit means, including second and third switching means connected together at a junction point and a capacitor connected at one side thereof to the junction point and at the other side thereof to the light-emitting element, for charging the capacitor with electric charge when the first switching means is in the first switching state and for discharging electric charge from the charged capacitor through the light-emitting element when the first switching means is in the second switching state to thereby drive the light-emitting element to emit light.

4. A drive circuit according to claim 3; wherein the second and third switching means are connected in series between a power source and ground.

5. A drive circuit according to claim 4; wherein the circuit means includes means for charging the capacitor to a potential level which is substantially greater than that of the power source.

6. A drive circuit according to claim 4; wherein the circuit means includes means for charging the capacitor to a potential level which is approximately twice that of the power source.

7. A drive circuit according to claim 4; wherein the second and third switching means comprise switching elements.

8. A drive circuit according to claim 7; wherein the switching elements comprise transistors.

9. A drive circuit according to claim 4; wherein the second and third switching means constitute part of a drive circuit for driving an electric motor.

10. A drive circuit according to claim 4; wherein the second and third switching means constitute part of a drive circuit for driving a DC motor.

11. A drive circuit according to claim 3; wherein the circuit means includes means for charging the capacitor to a potential level which is substantially greater than that of the power source.

12. A drive circuit according to claim 3; wherein the circuit means includes means for charging the capacitor to a potential level which is approximately twice that of the power source.

13. A drive circuit according to claim 3; wherein the second and third switching means comprise switching elements.

14. A drive circuit according to claim 13; wherein the switching elements comprise transistors.

15. A drive circuit according to claim 3; wherein the second and third switching means constitute part of a drive circuit for driving an electric motor.

16. A drive circuit according to claim 3; wherein the second and third switching means constitute part of a drive circuit for driving a DC motor.

* * * * *